United States Patent [19]

Williamson

[11] Patent Number: 4,545,581

[45] Date of Patent: Oct. 8, 1985

[54] GOLF PRACTICE AID

[76] Inventor: Paul J. Williamson, Dunes Station, Box 7095, Myrtle Beach, S.C. 29577

[21] Appl. No.: 546,283

[22] Filed: Oct. 28, 1983

[51] Int. Cl.[4] ..... A63B 69/36

[52] U.S. Cl. ..... 273/187 A

[58] Field of Search ..... 273/187 R, 187 A, 183 A, 273/187 B, 195 R; 435/252

[56] References Cited

U.S. PATENT DOCUMENTS 3,408,750 11/1968 McCollough et al. ..... 273/187 R 4,248,431 2/1981 Burnes ..... 273/187 R

FOREIGN PATENT DOCUMENTS 591840 8/1947 United Kingdom ..... 273/187 R 1305710 2/1973 United Kingdom ..... 273/187 R

*Primary Examiner*—George J. Marlo

*Attorney, Agent, or Firm*—Mills & Coats

[57] ABSTRACT

This invention is a visual golf practice aid for improving hand-eye coordination by the person actually being able to see the correct way to swing. This is accomplished through a plurality of parallel diagonal lines on a generally square base with a grid of large and small dots to indicate any undesirable sway movement from the fixed fulcrum point.

6 Claims, 5 Drawing Figures

GOLF PRACTICE AID

FIELD OF INVENTION

This invention relates to practice aids and more particularly to practice aids used in conjunction with the game of golf.

BACKGROUND OF INVENTION

Since the game of golf was first developed in Scotland, participants have continually strived to improve their game, particularly their stance and swing. Over the years various charts and maps have been used to align the feet of the golfer, the position of the ball, and/or the path of stroke for various clubs. Even extremely complex photographic apparatus have been used in attempts to show golfers their mistakes in swing form so that their game would improve.

Although each of these various prior art means have served some useful purpose, the various instruction charts and mats have been either impractical or inadequate to greatly improve the users golf game or have been too complex and too expensive as with the automatic photographic systems.

BRIEF DESCRIPTION OF INVENTION

After much research and study into the above-mentioned problems, the present invention has been developed to provide a relatively simple and yet highly efficient visual practice aid for improving hand-eye coordination, to allow the user to actually see the correct way to make a swing, and to immediately indicate when the neck which acts as the fulcrum or center point of the swing is undesirably swaying.

The above is accomplished through the provision of a generally square, mat-like structure having a plurality of parallelly disposed diagonal lines marked thereon with a grid made-up of large and small dots. When the player stands on the dot grid and aligns his hips and shoulders with the diagonal lines and swings a club parallel thereto, any appearance of movement in the grid will indicate undesirable sway in the neck which is the fulcrum or center point of the swing. Thus by daily practice the user of the pratice aid of the present invention can discover ways he can freely move his club through the hit zone while maintaining proper stroke form.

In view of the above, it is an objcet of the present invention to provide a golf visual practice aid which immediately indicates erroneous sway in the center point or fulcrum of the golfer's swing.

Another object of the present invention is to provide a means for making a golfer aware of swaying movement off the ball which effects his swing.

Another object of the present invention is to provide a means for aligning the shoulders and hips of a golfer relative to the ball and to act as a guide to the golfer's swing.

Another object of the present invention is to provide a mat-like structure having a plurality of parallely disposed diagonal lines marked thereon with a grid made up of large and small dots to indicate to the user thereof the correctness or incorrectness of his swinging movement.

Another object of the present invention is to provide a relatively inexpensive and yet highly efficient means for greatly improving the golf game of the user thereof.

Other objects and advantages of the present invention will become apparent and obvious from a study of the following description and the accompanying drawings which are merely illustrative of the present invention.

BRIEF DESCRIPTION OF DRAWINGS

FIG. 5 illustrates the follow through.

DETAILED DESCRIPTION OF INVENTION

Figure 1:
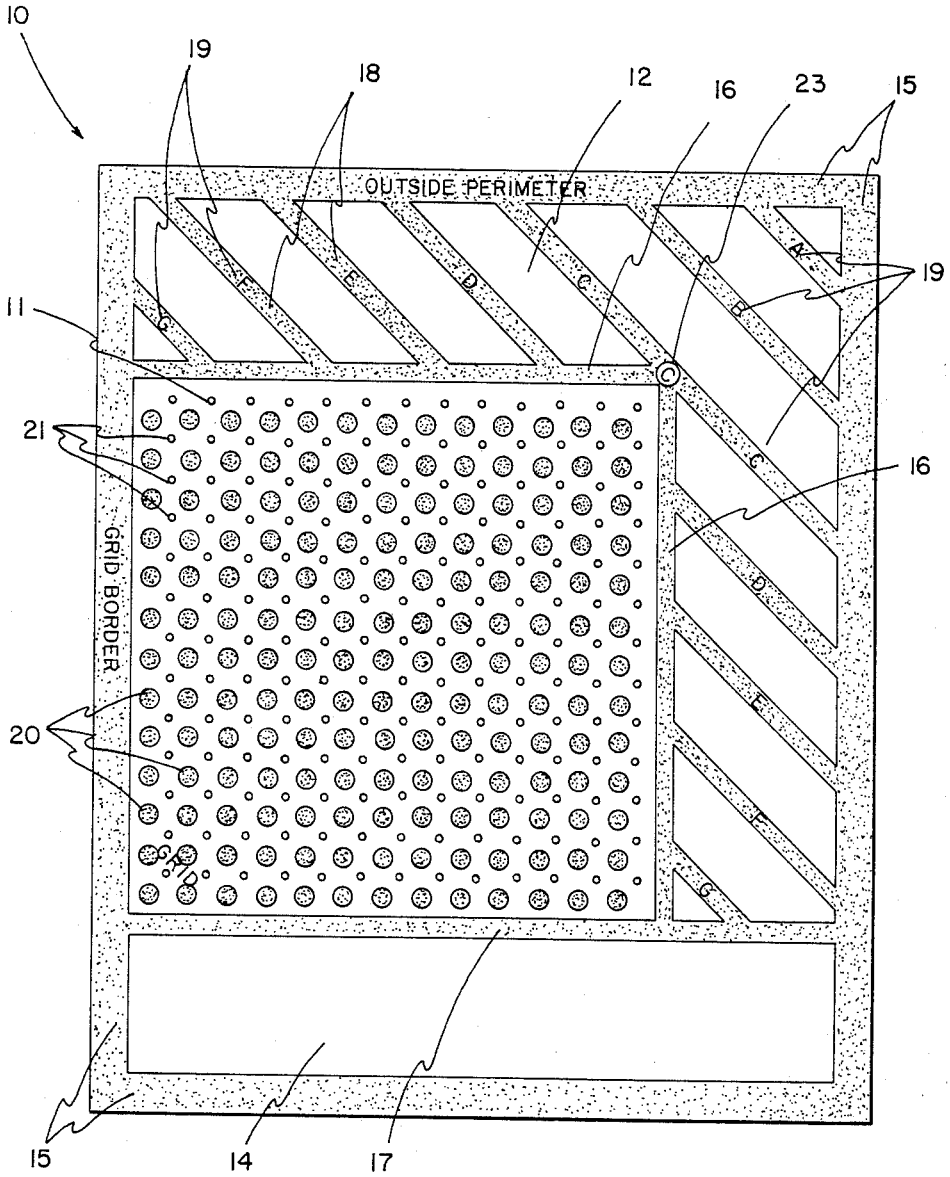
FIG. 1 is a top plan view of the golf practice aid of the present invention.

The practice aid of the present invention, indicated generally at 10, includes a sight area approximately 36 inches square made up of a dot grid portion 11 and an alignment line portion 12. The grid portion is disposed in a corner of the sight area and is approximately 27 inches square.

Since the practice aid 10 of the present invention is placed in a diamond configuration relative to the path of the swing, along one of the rear edges can be provided an area for trademarks, sponsor names, and/or advertising material, as indicated at 14. The sight of this commercial portion is the length of the sight area and approximately 7 inches in width.

The exterior border 15 is approximately 2 inches wide while the interior border 16 is approximately 1 inch wide as is the border 17 separating the commercial portion 14 from the grid and line portions 11 and 12. Additionally, the diagonal alignment lines 18 are approximately 1 inch wide and include indicia 19 marked thereon.

From the above it can be seen that the overall dimensions of the golf practice aid 10 of the present invention are approximately 40 inches by 48 inches with the practice sight area being approximately 36 inches square.

The grid portion 11 of the present invention is composed of a plurality of large dots 20 and a plurality of small dots 21 aligned in parallel rows.

By aligning alternate small and large dots, diagonal lines are formed perpendicular to alignment lines 18. The advantages of these grid dots will become more apparent from the following description.

The "C" within a circle denotation indicated at 23 shows the position of the ball in the stance.

To use the golf practice aid 10 of the present invention, the same is laid on a generally flat surface and the user 22 thereof assumes a comfortable stance on the grid portion 11 generally perpendicular to grid lines 18. The handle 26 of club 24 is gripped in the normal manner and the club head 25 addresses the imaginary ball at the circled C indicia 23. This address stance is shown clearly in FIG. 2.

The alignment line marked C is, of course, the swing line along which head 25 of club 24 travels. Once the address position is assumed as described above, alignment lines D, E, F and G become alignment lines for the shoulders and hips of golfer 22. The base of the neck 27 is the fulcrum or center point of the golfer's swing. During a proper swing, this point does not move.

Figure 3:
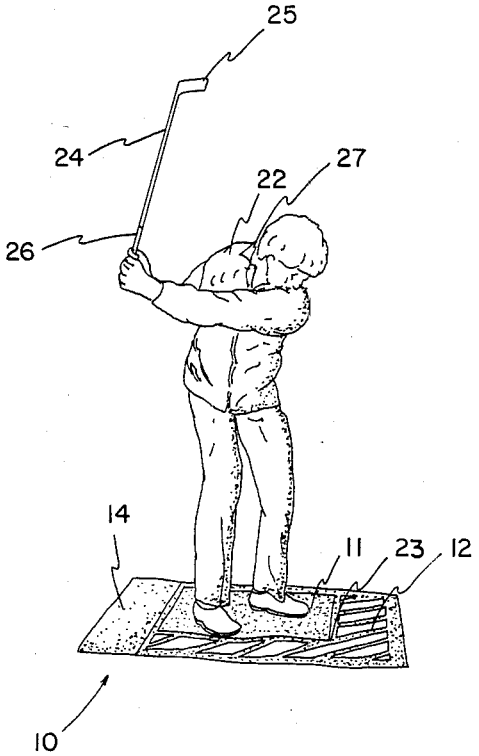
FIG. 3 is the same golfer at the peak of his backstroke.

As the club 24 is raised to the peak of the backstroke as shown in FIG. 3, the eye of the golfer remains on the ball indicia 23 and the back of the neck remains stationary.

Figure 4:
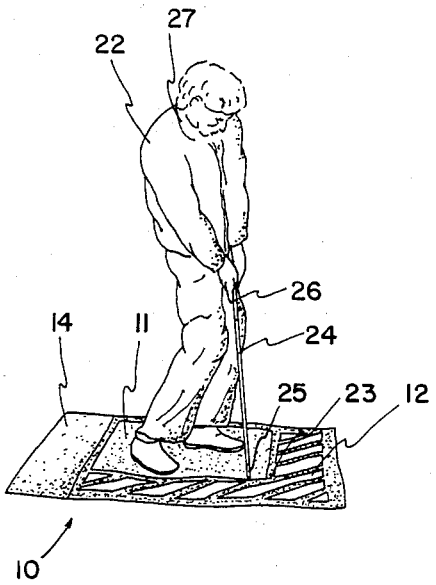
FIG. 4 is the same golfer in his downswing as the club passes through the hitting zone.

As the downswing is made as illustrated in FIG. 4, with the club head 25 passing down alignment line C, past ball indicia 23, the fulcrum point 27 at the back of the neck of the golfer continues to remain stationary relative to the practice aid 10.

Figure 5:
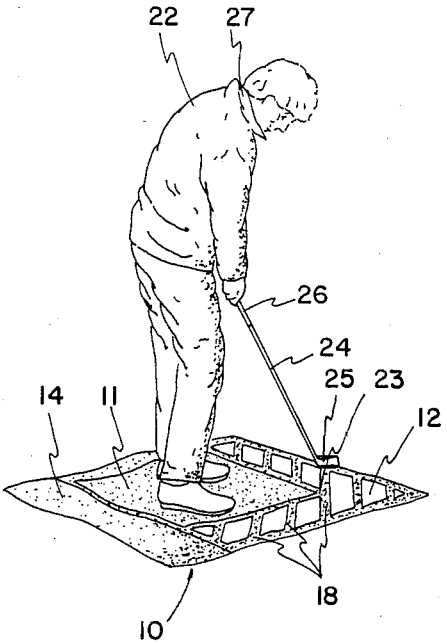

As the follow through of the swing is made, the fulcrum point 27 continues to remain stationary as shown in FIG. 5.

Figure 2:
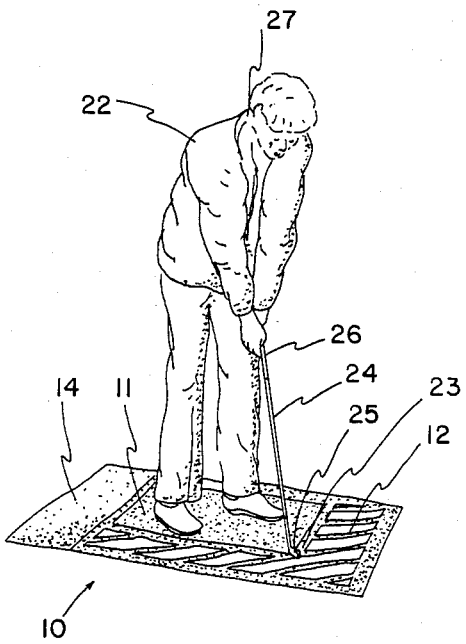
FIG. 2 is a perspective view of a golfer in address position using the aid.

After addressing the ball indicia 23 as shown in FIG. 2, if during the backstroke, the downswing or the follow-through, it appears that the grid 11 moves, then the base of the neck or center point of the swing 27 has moved. In other words if the grid 11 appears stationary following the address position, through the backstroke, downswing and follow through, then a correct swing has been accomplished. Any apparent movement in the grid, however, indicates that the neck has moved either left or right, backward or forward, up or down, which naturally affects the flight of a ball during play.

The practice aid of the present invention can be used anywhere and unobstructed swing can be accomplished, either inside or outdoors. When used on a regular basis, it can make the golfer aware of any sway or movement off the ball and allows a more relaxed and confident position to be assumed thereby greatly enhancing later golf play.

Although the aid 10 could be used during actual play, it is primarily designed as a practice device which greatly facilitates the learning of proper stance and swing characteristics.

From the above it is obvious that the present invention has the advantage of providing a relatively inexpensive and yet highly efficient means for indicating undesirable sway and movement off the ball during the practice of golf swings. By correcting this sway or undesirable movement, the game of the golfer is greatly improved. The present invention has the additional advantage of being usable either indoors or outside and is compact when stored.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An improved golf practice aid for indicating undesirable swaying movement which effects the golf swing comprising: a generally square mat having a generally square grid portion disposed in one corner thereof and an L-shaped alignment line portion adjacent to two-sides of said grid portion; ball location indicia associated with said grid portion and said alignment portion of said mat-like base for indicating the position of a golf ball; a grid pattern formed in said grid portion of said mat for aligning the stance of the golfer in relation to said ball location indicia; and a plurality of generally parallel alignment lines formed in said L-shaped alignment line portion of said mat and disposed diagonally to said generally square grid portion for aligning the shoulders and hips of the golfer in relation to said ball location indicia whereby any sway or movement off proper position during practice swings will be visually indicated by apparent movement of said grid pattern formed in said grid portion of said mat.

2. The practice aid of claim 1 wherein said grid pattern is a plurality of dots.

3. The practice aid of claim 2 wherein said dots are arranged in rows.

4. The practice aid of claim 3 wherein said rows of dots are alternately large and small dots.

5. The practice aid of claim 1 wherein at least one of said alignment lines extends across said ball location indicia for aligning the swing of the user thereof.

6. The practice aid of claim 1 wherein said alignment lines are disposed of at a 45 degree angle to said generally square grid portion of said mat-like base.

* * * * *